US007806301B1

(12) United States Patent
Ciavarella et al.

(10) Patent No.: US 7,806,301 B1
(45) Date of Patent: Oct. 5, 2010

(54) DOME PUMP

(75) Inventors: Nick E Ciavarella, Seven Hills, OH (US); Aaron R Reynolds, North Canton, OH (US); Daniel M Willis, Clinton, OH (US); Robert H Yeager, Twinsburg, OH (US)

(73) Assignee: Joseph S Kanfer, Richfield, OH (US)

( * ) Notice: Subject to any disclaimer, the term of this patent is extended or adjusted under 35 U.S.C. 154(b) by 48 days.

(21) Appl. No.: 10/849,669

(22) Filed: May 19, 2004

(51) Int. Cl.
*B65D 37/00* (2006.01)

(52) U.S. Cl. ..... 222/207; 222/181.3; 222/494; 417/479

(58) Field of Classification Search ..... 222/181.2, 222/181.3, 207, 209, 383.1, 406, 490, 494, 222/180, 181.1, 206, 214; 417/472, 478–480; 604/153; 128/DIG. 12
See application file for complete search history.

(56) References Cited

U.S. PATENT DOCUMENTS

| | | | | | |
|---|---|---|---|---|---|
| 3,162,333 | A | | 12/1964 | Davidson | |
| 3,507,586 | A | * | 4/1970 | Kutik et al. | 417/480 |
| 3,752,366 | A | * | 8/1973 | Lawrence, Jr. | 222/207 |
| 3,820,689 | A | | 6/1974 | Cocita | |
| 3,973,700 | A | * | 8/1976 | Schmidt et al. | 222/153.13 |
| 3,987,938 | A | * | 10/1976 | Cooprider et al. | 222/209 |
| 4,330,071 | A | | 5/1982 | Ohlson | |
| 4,561,571 | A | * | 12/1985 | Chen | 222/207 |
| 4,867,347 | A | | 9/1989 | Wass et al. | |
| 5,099,885 | A | | 3/1992 | Nilsson | |
| 5,176,510 | A | | 1/1993 | Nilsson | |
| 5,505,341 | A | * | 4/1996 | Gueret | 222/207 |
| 5,829,640 | A | | 11/1998 | Hershey et al. | |
| 5,918,776 | A | | 7/1999 | Atkinson | |
| 6,216,916 | B1 | | 4/2001 | Maddox et al. | |
| 6,425,501 | B1 | * | 7/2002 | Keung et al. | 222/207 |
| 6,619,512 | B1 | * | 9/2003 | Sayers et al. | 222/207 |
| 6,789,354 | B2 | * | 9/2004 | Wells | 47/57.5 |
| 2005/0087555 | A1 | * | 4/2005 | Hatton et al. | 222/209 |

FOREIGN PATENT DOCUMENTS

| | | | |
|---|---|---|---|
| DE | 3430646 | A1 | 3/1985 |
| FR | 2668456 | * | 10/1990 |
| GB | 2 155 435 | A | 9/1985 |

* cited by examiner

*Primary Examiner*—J. Casimer Jacyna
(74) *Attorney, Agent, or Firm*—Renner, Kenner, Greive, Bobak, Taylor & Weber

(57) ABSTRACT

A pump for dispensing soap from a container in a dispenser, the pump including a base, a flexible dome attached to the base defining a chamber therebetween, an inlet and an outlet formed in the base and opening into the chamber, the inlet being in fluid communication with the container, and wherein the dome has a fold line that facilitates collapsing of the dome. The dome may include an inwardly extending flange that selectively closes the inlet.

6 Claims, 4 Drawing Sheets

DOME PUMP

RELATED PATENT APPLICATIONS

None.

TECHNICAL FIELD

In general, the present invention relates to a pump used in a soap dispenser. More particularly, the present invention relates to a diaphragm pump having a flexible dome that is depressed to pump soap from the dispenser. Most particularly, the present invention relates to a diaphragm pump having a dome that includes a fold line that reduces pumping force and provides for more complete discharge of fluid from the pump. The present invention further relates to a dome having an inwardly extending flap that acts as an inlet value.

BACKGROUND OF THE INVENTION

Dispensers are widely available for dispensing a variety of flowable materials including creams, lotions, soaps and pastes, all of which will be generally referred to as "soap." These dispensers incorporate a variety of pumps including diaphragm pumps. In most cases, the diaphragm pump includes a base to which a flexible dome is attached to define a pumping chamber therebetween. The flexible dome component is used to create pressure to open an outlet valve and release product from the dispenser and also create a vacuum that opens an inlet valve to bring product back into the pump chamber.

Existing domes, generally have a continuous surface and are typically hemispherical in shape. As a result, the existing domes do not collapse in a repeatable consistent fashion. For example, sometimes, one side of the dome will collapse to a greater extent than another side upon application of the same force at the same location. These inconsistencies affect pump performance by creating dead spaces, where fluid is trapped behind the collapsed portion of the dome and cannot escape through the outlet. As a result, less than a complete charge of fluid is dispensed from the pumping chamber.

In similar fashion, existing domes require a relatively large amount of force to collapse the dome. When larger and smaller pump output is desired, the size of the dome must be increased to keep optimum pump efficiency constant as measured by compression ratio and the ratio of dead space to the dome internal volume. This is of particular concern, when a customer requests a different output because the ancillary pump components must also change size in order to accommodate the larger dome. Most times, however, compromises in performance are accepted over changing these components.

To account for the relatively large force needed to compress the domes, most dispensers incorporate a lever that provides a mechanical advantage to allow the user to pump soap from the dome. In hands free dispensers, larger or more batteries must be supplied to provide sufficient power with a minimally acceptable battery life.

As a result, there is a need for a diaphragm pump that requires relatively less force to dispense soap than existing dome pumps. There is a further need for a dome pump that collapses in a repeatable consistent fashion.

Further considering the issue of pump efficiency, another source of inefficiency is the currently used "floating" ball inlet check valve. The floating ball inlet check valve is provided at the inlet to prevent fluid from going back into the bottle when the dome is depressed. The floating ball rests in an open position allowing soap to fill the chamber beneath the dome, and closes in response to the pressure applied to the dome. As the ball floats toward the closed position, some soap leaks back through the inlet into the bottle. As a result, less than a complete charge of fluid is pumped from the chamber. Therefore, a better valve at the inlet would be desirable.

The floating ball design has additional disadvantages in that since it rests in an open position, the floating ball is prone to sticking after it rests for a period of time. Moreover, in terms of manufacture the floating ball design adds complexity to the pump assembly in terms of adding a component, namely the ball, providing inlet geometry that holds the ball in place, and, in assembly by adding the step of inserting the ball within the inlet. Consequently, a pump assembly that eliminates the floating ball inlet valve is desirable.

SUMMARY OF THE INVENTION

In light of the foregoing, it is an object of the present invention to provide an improved dome pump.

It is a further object of the present invention to provide a dome pump that requires less force to compress the dome than existing pumps.

It is still a further object of the present invention to provide a dome pump that collapses in a repeatable fashion.

It is yet another object of the present invention to provide a dome pump having a flap valve extending inward from the dome.

In view of at least one of the foregoing objects, the present invention generally provides a pump for dispensing soap from a container in a dispenser, the pump including a base, a flexible dome attached to the base defining a chamber therebetween, an inlet and an outlet formed in the base and opening into the chamber, the inlet being in fluid communication with the container, and wherein the dome has a fold line.

The present invention further provides a pump for dispensing soap from a container housed within a dispenser, the pump including a base, and, a flexible dome attached to the base defining a chamber therebetween, the dome having a first tier extending axially outward and radially inward from the base toward an annular shoulder that extends radially inward from an axial extremity of the first tier, and a second tier extending axially outward and radially inward from the annular shoulder defining a fold line between the first and second tiers, and an inlet and outlet formed in the base and opening into the chamber, where the inlet is in fluid communication with the container.

The present invention further provides a pump for dispensing soap from a container housed within a dispenser, the pump including a base, a flexible dome attached to the base defining a chamber therebetween, an inlet and an outlet formed in the base and opening into the chamber, the inlet being in fluid communication with the container, and a flexible flap extending inwardly from the dome into the chamber, the flap being adapted to selectively close the inlet.

BRIEF DESCRIPTION OF THE DRAWINGS

For a complete understanding of the objects, techniques and structure of the invention, reference should be made to the following detailed description and accompanying drawings wherein.

DETAILED DESCRIPTION OF THE INVENTION

Figure 1:
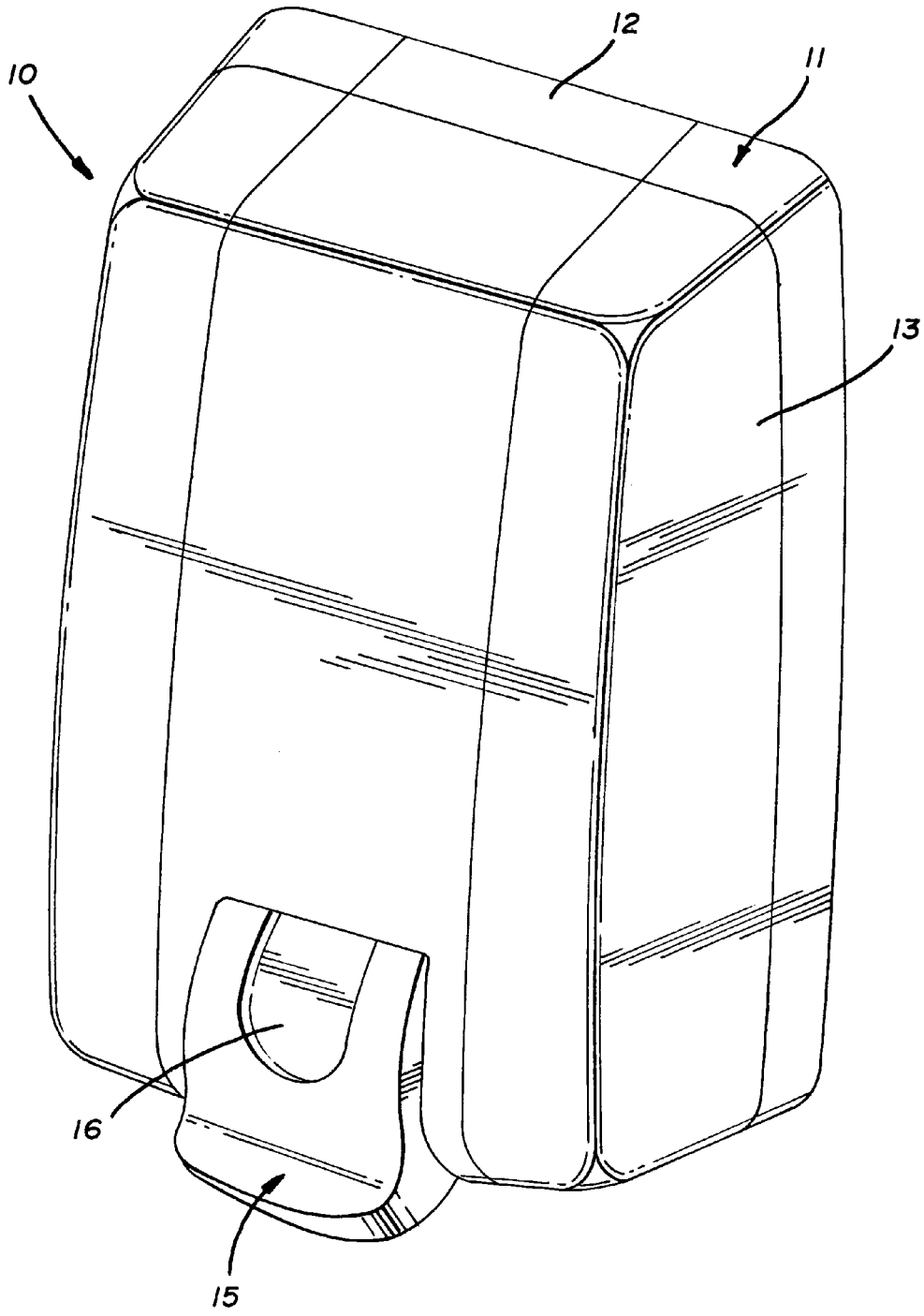
FIG. 1 is perspective view of a soap dispenser having a pump assembly according to the concepts of the present invention.
Figure 2:
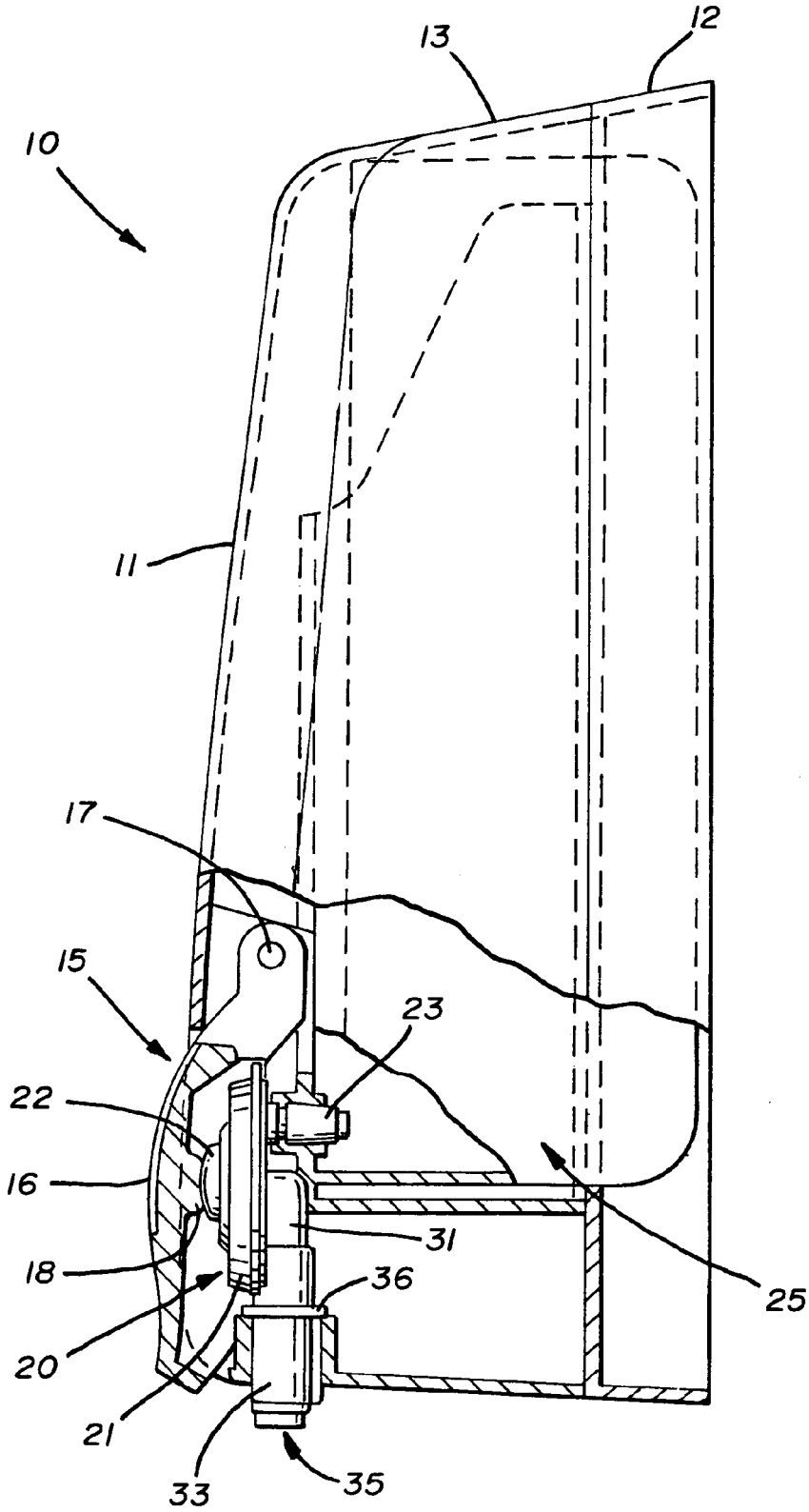
FIG. 2 is partially sectioned partially cut away side elevational view of the dispenser depicted in FIG. 1 showing details of the pump assembly.

A dispenser having a pump assembly according to the concepts of the present invention is depicted in FIGS. 1 and 2 and generally indicated by the numeral 10. The dispenser 10 may be any of a number of dispensers available in the art and thus only a general description of its components will be made. The dispenser 10 includes a housing 11 having a base 12 and a cover 13. The cover 13 is typically removable from the base and may be hingedly attached to allow repeated opening and closing of the cover 13. A push bar assembly, generally indicated by the numeral 15, may be attached to the cover 13 and is generally located, such that it is engagable with the pump assembly, generally indicated by the numeral 20, and best shown in FIG. 2.

With continued reference to FIG. 2, it may be seen that the push bar assembly 15 may include a lever 16 pivotally attached to the cover 13 by a pin 17 or similar member. Lever 16 extends downwardly over the pump assembly 20 and may include a rearwardly extending projection 18 adapted to engage the pump assembly and provide some mechanical advantage to the user.

Figure 3:
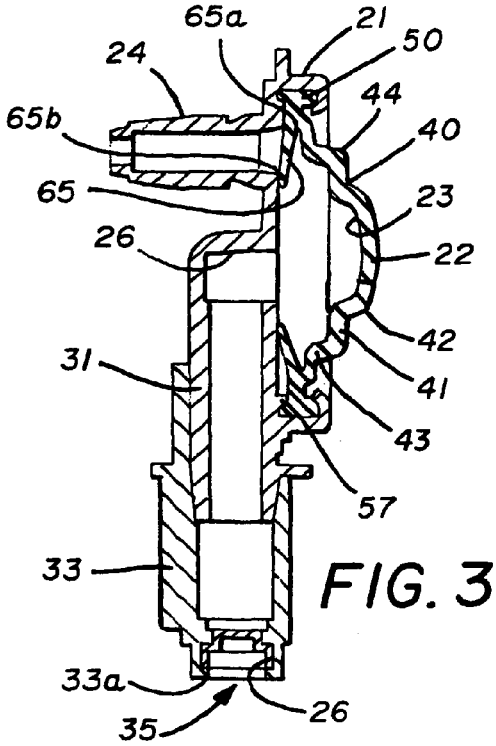
FIG. 3 is a sectioned side elevational view of a pump assembly according to the concepts of the present invention.

The pump assembly 20 is a diaphragm pump and includes a base 21 and a flexible dome 22. With reference to FIG. 3, the dome 22 and base 21 define a chamber 23 therebetween suitable for storing a charge of soap. Soap is drawn into the chamber 23 through an inlet 24 that extends rearwardly from the base 21 and into the soap container, generally indicated by the numeral 25 in FIG. 2, to draw soap therefrom. A suitable valve, such as a check valve or the flap valve 65 (shown) may be used to allow soap to enter the chamber 23 and prevent it from returning to the container 25 during the pumping stroke. The valve may be of any type available in the art including, for example, a ball valve, septum valve, or in accordance with a separate aspect of the present invention an integral flap may be provided on the dome 22, as will be described more completely below.

To discharge soap from the chamber 23, base 21 further includes an outlet 30 defined therein, the outlet 30 may communicate with an outlet passage 31 extending behind the base 21 and downwardly toward a nozzle 33, where fluid is ultimately dispensed at 35. As shown, the nozzle 33 may snap onto the outlet passage 31. Nozzle 33 may include a radially extending flange 36, best shown in FIG. 7, that helps locate the nozzle 33 within the dispenser 10, as shown in FIG. 2.

Figure 6:
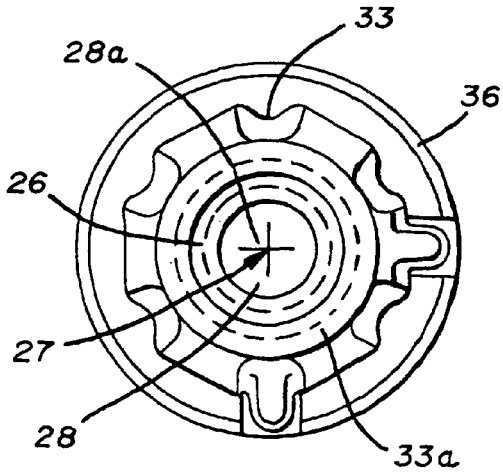
FIG. 6 is a bottom plan view of an outlet in the pump assembly.
Figure 7:
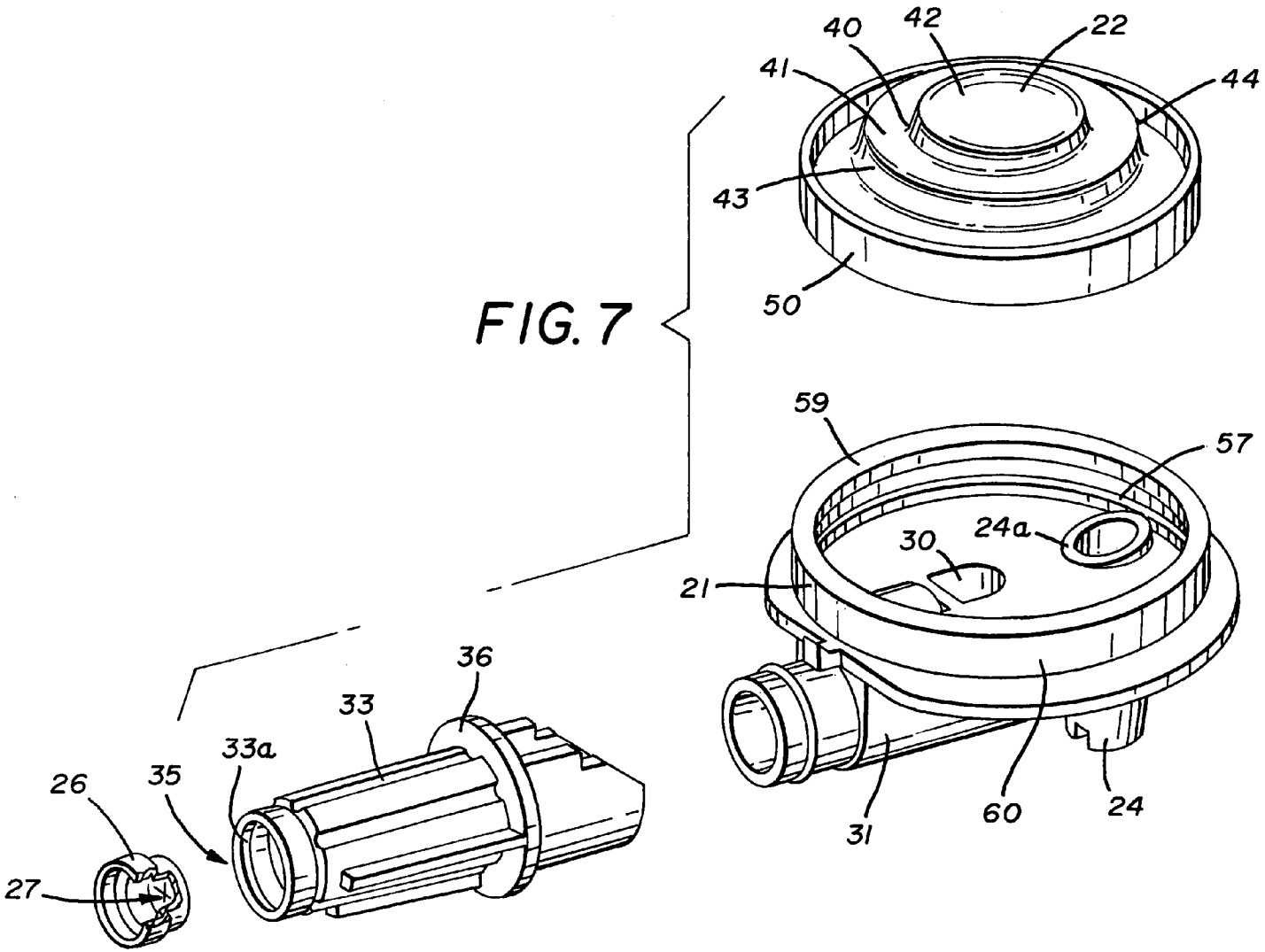
FIG. 7 is an exploded perspective view of a pump assembly according to the concepts of the present invention partially cut away to show details of an outlet valve mounted in the nozzle.

As will be appreciated, soap residue may cling to the outlet passageway 31 and over time drip from the nozzle 33. To prevent such dripping, a valve 26 may be provided downstream of outlet 30. The valve 26 may be of any type including a ball check valve or the like. In the example shown, a septum-type valve 26 is provided at the tip of the nozzle 33. As best shown in FIGS. 6 and 7, the septum valve 26 may include a pair of slits, generally indicated by the numeral 27, formed in a flexible end wall 28. Due to their flexible nature, the flaps 28*a* formed between slits 27 may be biased axially outward by the pressure of the soap exiting chamber 23 when the dome 22 is collapsed. Otherwise, the flaps 28*a* rest in a closed position shown in FIG. 3 closing the nozzle 33 to prevent soap from dripping therefrom. As shown, the valve 26 may be formed as a two-tiered structure with a axial outward tier that is larger than the inward tier to conform the valve 26 to the nozzle 33 and provide additional support to the endwall 28. Attachment of the valve 26 may be made in any known manner. In the example shown, nozzle 33 is provided with a lip 33*a* that extends radially inward to trap the valve 26 within the end of the nozzle 33. As shown, the lip 33*a* extends radially inward to a small extent to grasp the edge of the valve 26 without interfering with the flow of soap from the nozzle 33.

In accordance with one aspect of the invention, the flexible dome 22 is adapted to collapse in a consistent fashion. To that end, the dome 22 may be provided with a fold line, generally indicated by the numeral 40. A "fold line" is a structure formed integrally in the dome 22 to control or facilitate the collapse thereof. For example, the fold line 40 may include a positive or negative structure within the dome 22, such as a reinforced area that resists buckling causing a relatively weaker area to buckle, or a weakened area created by removing material. The fold line 40 may also be a pre-stressed area that changes the moment of inertia of the dome to increase the likelihood of buckling in a defined area. In the example shown, fold line 40 includes a crease formed between first and second tiers 41, 42 in the dome 22. The crease outlines the second tier 47 increasing its propensity to collapse, as described more completely below. As best shown in FIG. 3, as opposed to extending in a continuous hemispherical fashion, as is common in the art, dome 22 includes a forwardly extending wall 43 that extends forwardly and radially inward toward a first shoulder 44, where a dome 22 extends radially inward to form first tier 41 and then at a second corner, again extends forward and radially inward toward the second tier 42 defining the fold line 40 between the first and second tiers 41, 42. As shown in FIG. 3, the second tier 42 may have a dome-like configuration.

Figure 4:
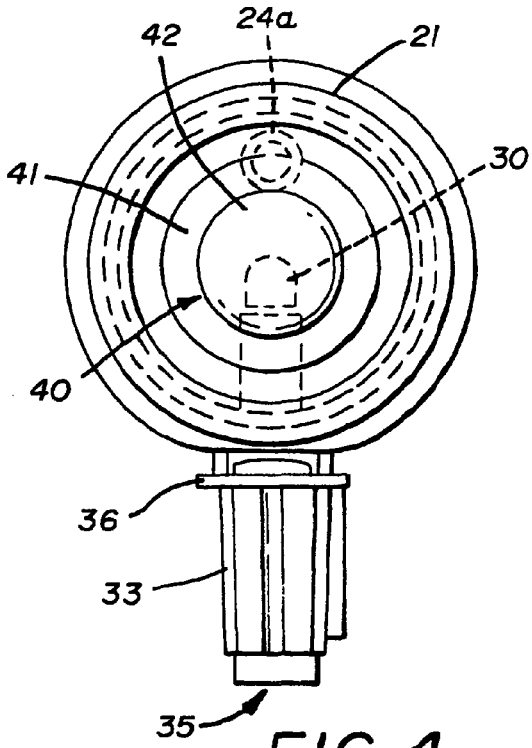
FIG. 4 is a front elevational view of the pump assembly shown in FIG. 3.

As best shown in FIG. 4, the fold line 40 and tiers 41, 42 may be circular. The effect of fold line 40 is to define a compressible area, which generally corresponds to the second tier 42, that is relatively easier to compress. Since the fold line 40 defines a readily compressible area, the area circumscribed by the fold line 40 collapses in a consistent repeatable fashion with less applied force than conventional domes. In this way, mechanical compression of the dome 22 may occur in a consistent manner that provides for a more complete evacuation of the fluid. In particular, the fold line 40 is located on the dome 22, such that it circumscribes an area that is prone to the creation of dead space i.e. space where fluid becomes trapped and cannot be dispensed, such that the readily compressible area avoids the formation of this dead space.

Figure 5:
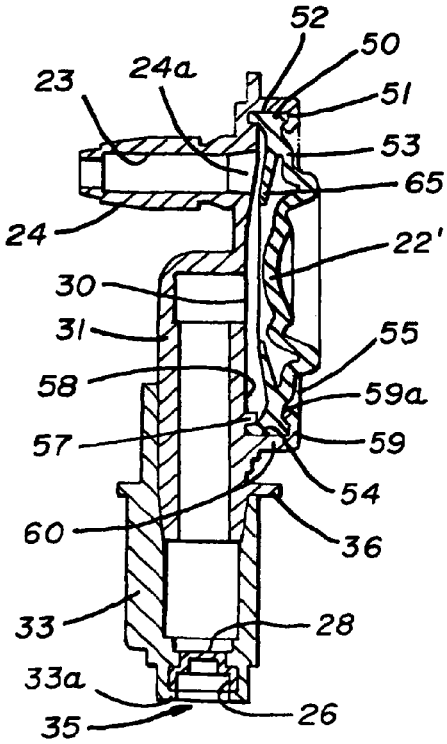
FIG. 5 is a sectioned side elevational view similar to FIG. 3 showing the dome in a collapsed position.

In accordance with another aspect of the present invention, the dome 22 may include an attachment portion, generally indicated by the numeral 50, generally at its perimeter 51. This assembly may be used to attach the dome 22 to the base 21 without a snap ring, as commonly done in the art. As best shown in FIGS. 3 and 5, the dome 22 includes a circumferential flange 52 that extends axially outward from the dome body 53 and is adapted to reside in a channel 54 defined by the wall 55 of the base 21. As best shown in FIG. 5, the circumferential channel 55 formed in the base 21 includes a rim 57 extending forwardly from the floor 58 of the base 21 to grasp a rearwardly extending portion of the flange 52. The base 21 further includes a lip 59 that curls inward and rearward from the outer wall 60 of the base 21 to grasp the forwardly extending portion of flange 52. To further secure the dome 22 or as an alternative to flange 52, a snap ring may be used to clamp the dome 22 in place.

Since the dome 22 and accordingly the flange 52 are made of a flexible material, the flange 52 may be compressed to fit within the channel and expand upon release to securely attach the dome 22 to the base 21 in a sealing arrangement.

In accordance with yet another aspect of the present invention the dome 22 may be provided with a radially inwardly extending flap 65 that may be used as an inlet valve to prevent soap from returning to the container 25 during the pumping stroke. The flap 65 may be formed integrally with dome 22 ie. as a single unit. In general, flap 65 covers inlet 24 to prevent soap from reentering the container 25 from chamber 23. As shown, the flap 65 may rest in a closed position (FIG. 3). By resting in the closed position, flap 65 eliminates the leakage associated with the prior art "floating ball" valve. When arranging the flap 65 in this configuration, the negative pressure created upon release of the collapsed dome (FIG. 5) pulls the flap 65 away from inlet 24 to allow soap to enter the chamber 23. In further comparison to the floating ball design, the use of the integrally formed flap 65 reduces manufacturing complexity by eliminating the additional ball component, the specialized inlet geometry used to accommodate the ball, and the assembly step of installing the ball.

As shown in FIG. 3, as needed, flap 65 may extend radially inward and axially outward relative to dome 22 to cover inlet 24 and contact the floor 58 of base 21. It will be appreciated that the extension of flap 65 may vary to accommodate various inlet positions. In the example shown, inlet opening 24 is spaced axially outward of the base 65*a* of the flap 65. To accommodate this inlet position, flap 65 extends axially outward to an edge 65*b* that contacts floor 58 of base 21 on the far side of inlet 24. The axial extension of flap 65 may be greater than the axial position of inlet 24 to create a bias within the flap 65 against the floor 58 of base 21 improving the flap's sealing contact with the base 58. Alternatively, the floor 58 of base 21 may include a raised portion to improve sealing contact with the flap 65. For example, as shown, a sealing ring 24*a* may be provided about the opening of inlet 24 and be raised from floor 58. Optionally, as best shown in FIGS. 5 and 7, the top surface of the ring 24*a* may slope toward the floor in the radial inward direction to follow the slope of the flap 65. In this way, the flap 65 may lie flat against the top surface of ring 24*a* further improving its ability to maintain a good seal.

As is further shown, inlet 24 may be located radially outward of outlet 30, such that the radial inward extension of a flap 65 that extends about the entire circumference of dome 22 does not cover the outlet 30. By using a flap 65 that extends about the entire circumference of dome 22, assembly of the dome 22 and base 21 may be made without having to circumferentially align the flap 65 and inlet 24.

It will be appreciated that the flap 65 may, however, be formed to extend along only a portion of the dome's circumference necessary to cover the inlet 24 and avoid interference with the outlet 30. For example, if the inlet 24 is located at an upper portion of the chamber 23 and the outlet 30 is located at a lower portion of the chamber 23, the flap may extend inwardly from only the upper portion of the dome 22 leaving the outlet 30 open. As discussed previously, the outlet 30 may be provided with its own check valve to prevent soap from leaking from the chamber 23, when the pump is not in use.

In light of the foregoing, it should thus be evident that a dome pump for dispensing soap, according to the concepts of the present invention, substantially improves the art. While, in accordance with the patent statutes, only the preferred embodiment of the present invention has been described in detail hereinabove, the present invention is not to be limited thereto or thereby. It will be appreciated that various modifications may be made to the above-described embodiment without departing from the invention. Therefore, to appreciate the scope of the invention, reference should be made to the following claims.

What is claimed is:

1. A pump for dispensing soap from a container housed within a dispenser, said pump comprising:

a base having a floor and a wall extending axially outward from said floor;

a flexible dome attached to said base defining a chamber therebetween, said flexible dome including a base periphery;

an inlet formed in said floor and an outlet formed in said base and opening into said chamber, said inlet being in fluid communication with the container; and a flexible flap extending inwardly from said base periphery of said dome into said chamber substantially parallel to said floor, said flap being adapted to selectively close said inlet, wherein said outlet is located radially inward of said flap such that said flap does not cover said outlet, and further wherein said flap extends inwardly about the entire base periphery such that said flap does not have to be circumferentially aligned with said inlet to cover the same.

2. The pump of claim 1, wherein said inlet is formed in said base at a position axially outward of a base of said flap and wherein said flap extends axially outward toward a radially inward edge contacting said base on a far side of said inlet opening.

3. The pump of claim 1, wherein said flexible flap is adapted to cover said inlet in a resting position and flex inward opening said inlet when a negative pressure is created within said chamber.

4. The pump of claim 1 further comprising a sealing ring extending inward from said base around said inlet, said sealing ring sloping axially outward as it extends radially inward, and wherein said flap is engageable with said sealing ring to close said inlet.

5. The pump of claim 1 further comprising a valve adapted to selectively open and close said outlet.

6. A pump for dispensing soap from a container housed within a dispenser, said pump comprising:

a base having a floor and a wall extending axially outward from said floor;

a flexible dome attached to said base defining a chamber therebetween, said flexible dome including a base periphery;

an inlet formed in said floor and an outlet formed in said base and opening into said chamber, said inlet being in fluid communication with the container;

a flexible flap extending inwardly from said base periphery of said dome into said chamber substantially parallel to said floor, said flap being adapted to selectively close said inlet, wherein said outlet is located radially inward of said flap such that said flap does not cover said outlet;

a valve adapted to selectively open and close said outlet; and a nozzle extending from said outlet, said nozzle having a radially inward extending lip formed at its outer extremity, wherein said outlet valve is a septum valve and is insertable inward of said lip, whereby said lip holds said septum valve within said nozzle.

* * * * *